US008091262B2

(12) United States Patent
Poulokefalos

(10) Patent No.: US 8,091,262 B2
(45) Date of Patent: Jan. 10, 2012

(54) ATTACHABLE PRICE TAG HOLDER

(75) Inventor: Dimitris Poulokefalos, South Barrington, IL (US)

(73) Assignee: American Gasket Technologies, Inc., Addison, IL (US)

( * ) Notice: Subject to any disclaimer, the term of this patent is extended or adjusted under 35 U.S.C. 154(b) by 0 days.

(21) Appl. No.: 12/343,290

(22) Filed: Dec. 23, 2008

(65) Prior Publication Data

US 2010/0154265 A1 Jun. 24, 2010

(51) Int. Cl.
*G09F 3/18* (2006.01)

(52) U.S. Cl. ..... 40/661.05; 40/660; 40/607.12

(58) Field of Classification Search ..... 40/607.12, 40/637, 642.01, 660, 661.05
See application file for complete search history.

(56) References Cited

U.S. PATENT DOCUMENTS 1,848,950 A * 3/1932 Hammes ..... 40/660
2,262,873 A * 11/1941 Wise ..... 40/607.12
2,827,309 A * 3/1958 Fred ..... 281/5
3,964,187 A * 6/1976 Stumpf ..... 40/27.5
4,560,133 A * 12/1985 Droz ..... 248/442
4,840,345 A * 6/1989 Neil et al. ..... 248/74.2
5,590,859 A * 1/1997 Lord ..... 248/62
5,645,175 A * 7/1997 Wood ..... 211/57.1
5,901,402 A * 5/1999 Williams ..... 15/144.1
5,975,009 A * 11/1999 Nihra et al. ..... 116/173
5,979,674 A * 11/1999 Thalenfeld ..... 211/57.1
6,098,327 A * 8/2000 Gallant ..... 40/634
6,186,454 B1 * 2/2001 Olsen ..... 248/218.4
6,381,890 B1 * 5/2002 Sjostedt ..... 40/637
6,389,722 B1 * 5/2002 Josefsson et al. ..... 40/642.01
2009/0019751 A1 * 1/2009 Goetting ..... 40/663

* cited by examiner

*Primary Examiner* — Joanne Silbermann
*Assistant Examiner* — Christopher e Veraa
(74) *Attorney, Agent, or Firm* — Vangelis Economou; Economou IP Law

(57) ABSTRACT

Display tag holders in one integral part of an injection molded plastic, such as polyurethane, or acrylonitrile butadiene styrene, including an essentially planar display portion, a connecting portion and a ring attachment portion, the ring attachment portion having at least one flexible resilient ring segment including a proximal end closest to the display portion and at least one distal end, the at least one flexible resilient ring segment defining a circumferential direction and a ring plane in which the at least one flexible resilient ring segment essentially extends, wherein the at least one flexible resilient ring segment is attached to the display portion by the connecting portion so that the ring plane is essentially perpendicular to the plane of the planar display portion.

8 Claims, 3 Drawing Sheets

ATTACHABLE PRICE TAG HOLDER

BACKGROUND OF THE INVENTION

1. Field of the Invention

This invention relates generally to holders and more specifically relates to a holder for planar or sheet material wherein the holder includes a planar holding portion for holding planar material and an integral attachment mechanism of the planar holder portion to a wire or rod, which rod may have a variable dimension.

2. Background Art

The inventive holder is particularly applicable to sign holders or display devices that are useful in retail environments in which price sheets and the like are to be prominently displayed to prospective purchasers. However, it will be appreciated by those skilled in the art that the invention has broader applications, and may be utilizable in other applications in which it is convenient to hang items from a variable dimensioned mounting using a cinch, ring or contoured tab.

Conventional practice for retail establishments is to indicate the price of merchandise held on shelves with price tags attached to the shelf holding the items to be sold. Some examples of such price holders, other than price tags on the items themselves, are clips, slots, or rigid holders that retain the price tag or other identifying information attached to the shelf on which the items to be sold are displayed. In some instances, the rigid holder may be in the form of a planar member that has cantilevered top and bottom edges forming grooves into which price tags, for example, small rectangular sheets of paper or cardboard are inserted. Commonly owned U.S. Pat. No. 7,340,856 to Kalouris describes such a holder. Kalouris is an example of an adjustable tag holder that accommodates different diameter wires or other mounting means. The teachings of U.S. Pat. No. 7,340,856 are incorporated herein, where common elements are described, as if fully set forth.

Price tags mounted on a display shelf are usually positioned in a plane parallel to the shelf front edge or in a plane perpendicular to the front edge to call attention to the prospective purchaser the price or other identifying indicia of the merchandise goods, usually disposed directly behind the price tag holder. Price tags need to be mounted securely to prevent accidental dislodgment by passersby or to prevent deliberate tampering by persons bent on mischief. Besides the above mentioned Kalouris patent, known price tag holders utilize mechanical locking means, for example, a pin and slot arrangement, to prevent the removal of the price tag except by manually disengaging the locking means. Some such clips are made from several parts to facilitate the removal of temporary price sheets that are inserted therein until they are changed. However, multiple part arrangements of this type add to the manufacturing and utilization costs, as they require additional assembly and other steps to produce than does an integral or single piece device.

Conventional one piece price tag holders, for example, tags that are attachable around a wire mesh front wire in a wire mesh shelf have a specified diameter wire or metal rod to which they are attachable. The diameter of the rods making up the wire mesh shelves on occasion has a wire of a different, often larger size. In that event, a different size of attachment is necessary to securely hold the price tag holder on the wire mesh front wire or rod so as to inhibit lateral displacement along the rod or wire. To change over to different shelving systems may require obtaining a complete new set of price tag holders. Moreover, if two or several different types of shelving are utilized in a specified retail establishment, then as many types of price tag holders are necessary to use on the different wire mesh holders, thereby needlessly complicating the inventory of the retail establishment, adding to the carrying costs and taking up space that would otherwise be used for storage of retail merchandise.

The attachment mechanisms provided for attaching the price tag holders to a shelf are generally sturdy ones to avoid tampering or other accidental dislodgement, and usually include retaining members that are difficult to unlatch, and some even require special tools to unhook or otherwise unfasten the price tag holder from the mounting disposed on the shelf. For example, aforementioned U.S. Pat. No. 7,340,856 includes a hard plastic base that has a slot for insertion of a tab end that securely retains the tab end in the slot until a strong positive force is brought to the tab end to remove the tab end from the slot.

The desire that the retention mechanism be sturdy and hard to unfasten accidentally, while also inhibiting sideways displacement along the wire or rod on which it is mounted has tended toward a trend of more robust retention mechanisms, which contributes significantly to the cost of the tag holders. An inexpensive to produce and inexpensive to use, that is, reusable, means of retaining a price tag holder on the mounting means of a shelf is needed which also provides the capability of reutilizing a price tag holder by virtue of the easy disengagement of the holding or retention mechanism and reattachment at a different desired location.

SUMMARY OF THE INVENTION

The present invention provides a solution to these problems and describes and claims a display tag holder suitable for mounting onto an external elongated support member, the display tag holder comprising an essentially planar display portion, a connecting portion and a ring attachment portion that is connected to the display portion by the connecting portion, the ring attachment portion having at least one flexible resilient ring segment including a proximal end closest to the display portion and at least one distal end, the at least one flexible resilient ring segment defining a circumferential direction and a ring plane in which the at least one flexible resilient ring segment essentially extends, wherein the at least one flexible resilient ring segment is attached to the display portion by the connecting portion so that the ring plane is essentially perpendicular to the plane of the planar display portion. Preferably, the inventive merchandise display tag holder is one integral part and comprises an injection molded plastic, such as polyurethane, or acrylonitrile butadiene styrene

BRIEF DESCRIPTION OF THE DRAWING FIGURES

The present invention will now be discussed in further detail below with reference to the accompanying figures in which.

DETAILED DESCRIPTION OF THE PREFERRED EMBODIMENTS

Figure 1:
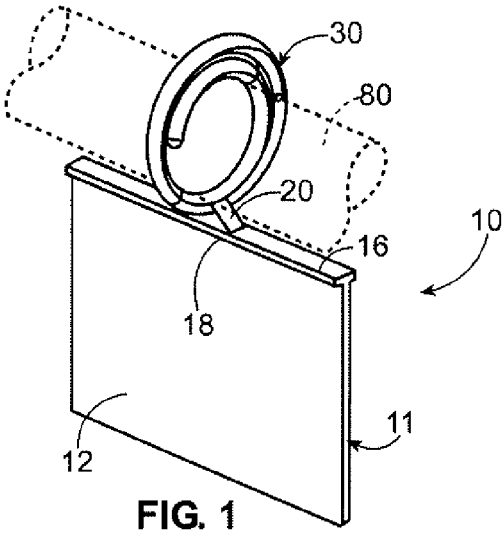
FIG. 1 is perspective view of a tag holder according to the present invention.
Figure 2:
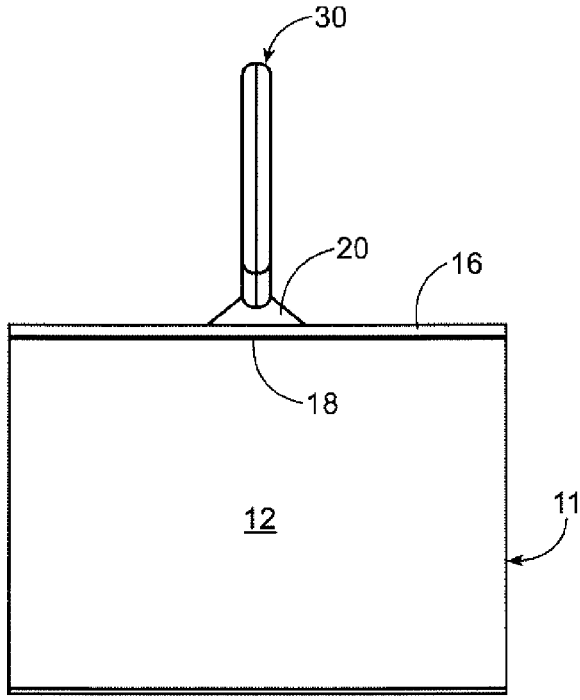
FIG. 2 is front elevational view of a price tag holder shown in FIG. 1.
Figure 3:
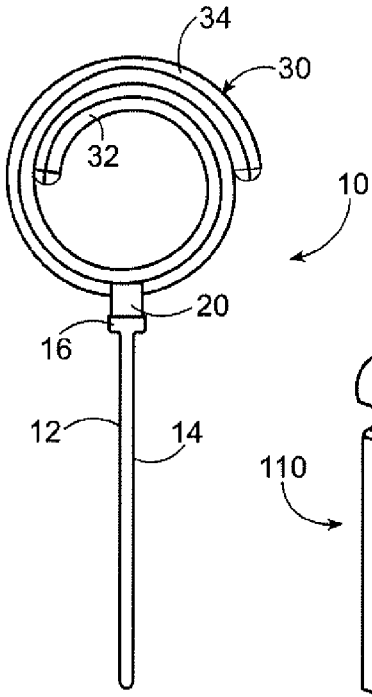
FIG. 3 is side elevational view of a price tag holder shown in FIG. 1.

Referring now to FIGS. 1-3, a first embodiment of the present invention price tag holder 10 is shown. A price tag portion 11, comprising a front surface 12 for displaying price information, and an opposed back surface 14 of the price tag display portion 11, is shown. Price tags made of a planar material, for example paper with an adhesive on one side may be affixed to the price tag holder front or back surfaces 12, 14, so that the price tags (not shown) are visible to the purchaser. Of course, if the back surface 14 is used to mount the price tag, the price tag display portion 11 should be clear so that the information on the price tag would be visible to the front face of the holder 10 and thus visible to the shopping public. The price tag display portion 11 may take any shape, but is preferably in the shape of a rectangle, as shown. The price tag portion 11, in and of itself, including the surfaces 12, 14, is in most instances conventional. A top edge 16 is disposed along the top of price tag portion 11, and is thicker than the thickness of the price tag portion 11. This configuration acts to provide rigidity to the price tag holder 11 so that it can retain its planar shape without twisting or bending.

At a central location 18 along the transverse extent of the edge 16, an integral attachment portion generally shown at 20 attaches the tag display portion 11 to a ring attachment portion 30, which in turn is attachable as will be described in detail below, to a wire mesh 80 (shown in phantom in FIG. 1) of a merchandising display. The wire mesh 80 is under normal circumstances the first or front wire of an arrangement of wires that are usually weldable to each other in a configuration forming wire shelves on which retail merchandise is displayed. The price tag display portion 11 thus normally will hang from the first wire 80, as shown in FIG. 1, in front of and above the merchandise on the shelf immediately below the wire 80. The configuration of the inventive ring attachment portion 30 provides a tight interference fit around the wire 80 to retain the holder 10 in position so it does not swing about the wire nor move laterally along the wire 80, as will be described below in more detail.

The ring attachment portion 30 is attached to the price tag portion 11 by the integral connecting portion 20, which is preferably triangularly shaped, as shown. It is integral with and attached to top edge 16 of the price tag portion 11, and also attached to a bottommost point of the periphery or circumference of the ring attachment portion 30. Most preferably, and so as to provide a manufacturing advantage, the ring attachment portion 30, the integral connecting portion 20 and the price tag portion 11 are all integral and formed in the course of a single molding procedure in a die mold (not shown). That is, the mold forming process that can be utilized to manufacture the display tag holder 10 is a single mold process, that once completed, produces that necessary product according to the present invention that can be shipped to the purchaser of the inventive holders for immediate mounting in a wire rack display. The thickness dimension of the connecting portion 20 is about the same thickness or slightly lesser than the thickness of the top edge 16, as shown in FIG. 3.

Integral ring attachment portion 30 and the other portions of the price display tag holder 10, such as the price tag portion 11 and the connecting portion 20, are formed from a relatively soft plastic, for example, polypropylene. This type of material permits temporary distortion of ring portion 30 while the tag holder is being mounted onto a wire mesh or rod 80. However, preferably it has sufficient resiliency to spring back and engage around the wire rod 80 and firmly attach thereto. The material preferably has enough frictional holding power to retain the display tag holder 10 in place at the portion of the rod 80 on which it has been mounted.

While the integral ring attachment potion 30 has been described as having a "circumference," it should be noted that strictly speaking the shape is not circumferential, but may be considered such as a general proposition. In fact, the ring portion as shown in FIG. 3 comprises two semicircular segments, an inner segment 32 and an outer segment 34. The outer segment 34 may have a slightly larger curvature so that the inner circumference of the outer segment 34 follows the contour of the outer circumference of the inner segment 32 as shown in FIG. 3. Each of the two segments 32, 34 may have an arc extending up to or about 2700, so that the inner circumference of the outer segment 34 overlaps to some degree over the outer circumference of segment 32. The radius of the inner segment 32 is dimensioned to provide a tight interference fit over a wire or rod 80 that is the smallest diameter contemplated for use with the device. For rods or wires 80 having larger diameters, the resiliency of the material comprising the ring attachment portion 30 allows the two ring segments 32, 34 to expand, and thereby to accommodate the larger size diameter of the rod 80, while maintaining the interference fit by its resilient power. It should be recognized that the of the ring attachment portion 30, that is the two segments 32, 34 are both preferably thin, so as to be flexible enough to loop around a rod or wire, such as wire or rod 80, but thick enough to provide a robust connection thereto.

One way to provide the desired configuration is to include the locus of the inner ring segment 32 at a position that is somewhat closer to the price tag portion 11 and also to have a decreasing radius of curvature in the inner segment 32 so that the two ring segments 32, 34 in effect form a spiraling semicircular attachment portion.

Figure 4:
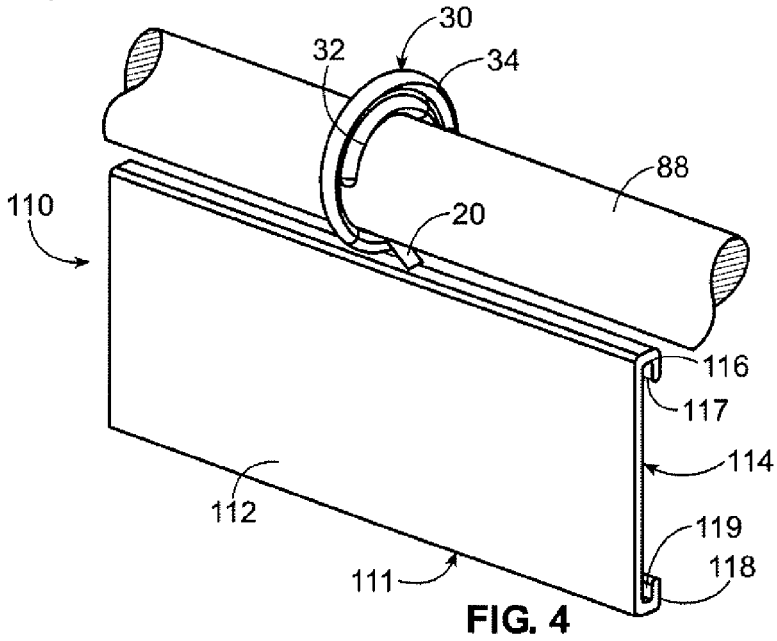
FIG. 4 is perspective view of a price tag holder according to another embodiment of the present invention shown being used in a typical retail environment.

Referring now to an alternative embodiment of the invention, shown in FIG. 4 is a display tag holder 11 O having three portions, a price tag display portion 110, a connecting portion 20 and a ring attachment portion 30. Since the two portions 20, 30 are in most respects identical to those of the embodiment shown in FIGS. 1-3, identical identification numbers are used. For those portions of the embodiment of FIG. 4, and also of the second alternative embodiment shown in FIGS. 5-7, that are different from the previously described embodiments, the identification numerals are accorded a similar number but having a prefix in a different hundred sequence.

Referring again to the display tag holder 110 shown in FIG. 4, only the different price tag display portion 111 will be discussed, the connecting portion 20 and ring attachment portion 30 being essentially identical to those of the embodiment shown in FIGS. 1-3. The price tag display portion 111 comprises a front surface 112 for displaying price information, and an opposed back surface 114 of the price tag portion 111. However, rather than a top edge 16, as in display tag holder 10, the extending top and bottom of the price tag portion 111 have cantilevered, or turned over edges, namely a top edge 116, and a bottom edge 118, each defining opposed grooves 117, 119 respectively. The opposed grooves 117, 119 provide a slot for inserting price tag information, in the form of a paper or cardboard tag through the slots of grooves 117, 119 to hold the price tag at its edges within the enclosed space provided the back wall 114 and the two cantilevered top and bottom edges 116, 118. In this respect, edges 116 and 118 are similar to those of the aforementioned commonly owned U.S. Pat. No. 7,340,856, and reference is made thereto for a more detailed discussion of the structure and function of the edges 116, 118 and grooves 117, 119.

Figure 5:
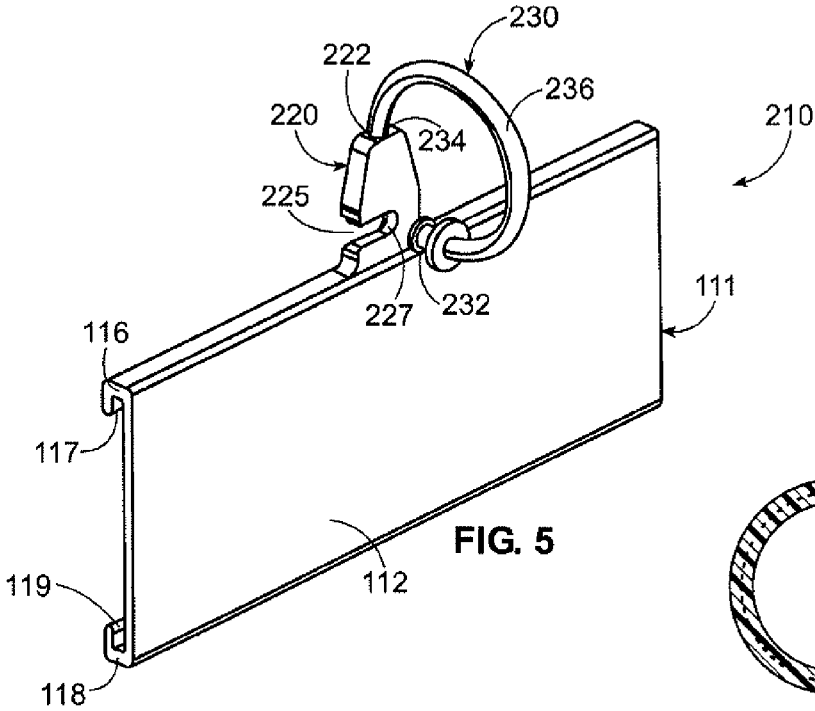
FIG. 5 is perspective view of another embodiment of the present inventive price tag holder.
Figure 7:
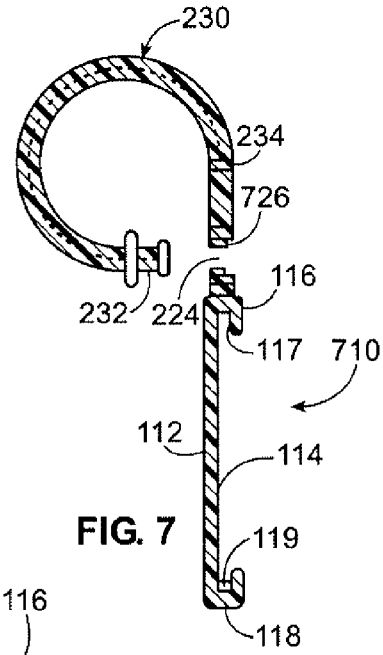
FIG. 7 is a cross-sectional side view of the price holder according to the present invention, taken approximately along the line 7-7 of FIG. 6.
Figure 6:
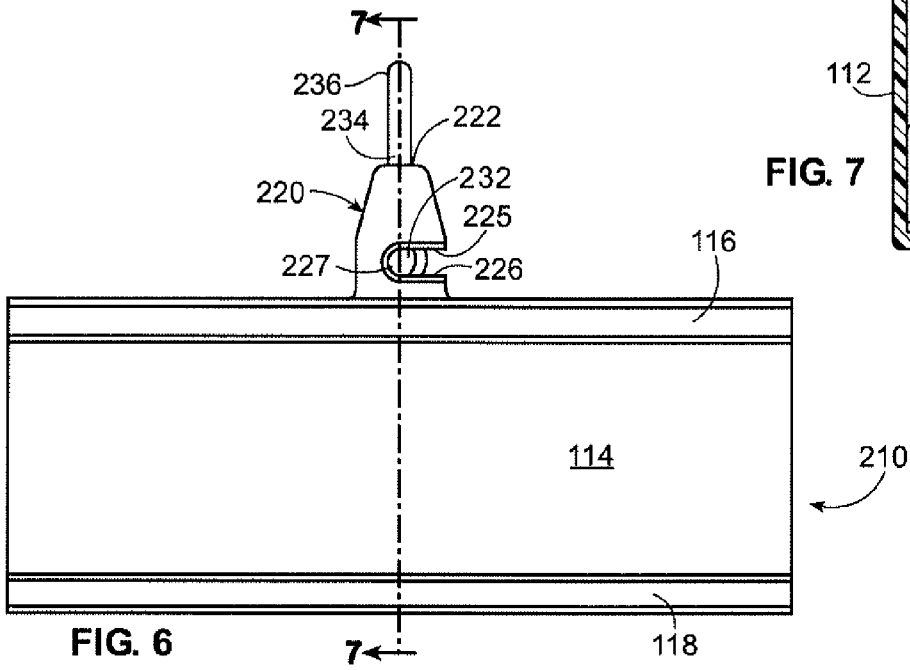
FIG. 6 is front elevational view of a price tag holder shown in FIG. 5.

Referring now to FIGS. 5-7, another embodiment of the inventive display tag holder 210 is shown, in which the price tag display portion is the same as that of the price tag display portion 111 of the second embodiment 110 shown in FIG. 4, but the connecting portion 220 and the ring attachment portion 230 are different. The differences are best shown in FIGS. 5 and 6, which show the connecting portion 220 as being centrally disposed along the top edge 116, but having a generally trapezoidal profile when viewed in plan view of FIG. 6. At a vertical distance approximately one third between the connection point to the edge 116 and the apex or top 222 of the connection portion 220, there is located a slot or eye 224 for receiving a fastening hook 232 disposed at the distal end 234 of the ring attachment portion 230. The width of the opening forming the eye 224 is approximately the same or slightly smaller than the diameter of the hook, if the hook is cylindrical.

The eye includes an open end 225 and a closed end 227, the width of the eye at each end shown being identical, but the closed end may taper to a slightly smaller width to provide a better interference fit to the hook 232 as will be apparent. One or more grooves 226, defining by a stepped profile in the slot 224, best seen in FIG. 7, may be disposed to provide a better interference fit with the end of the hook 232. As can be seen from the cross-sectional profile in FIG. 7, the ledge formed by the grooves 226 provide a seat for the end portion 238 of the hook 232 within the slot 224. A second protruding disc 240 also provides a resistance to movement of the hook 232 in the slot 224 by frictional contact between the outer periphery of disc 240 and the wall of the connecting portion 220.

The top or apex 222 of the connection portion 220 is adjacent the other or proximate end 234 of the ring attachment portion 230, which is attached to or preferably integral with the top 222. The ring attachment portion 230 extends from the connection point to the distal end and terminates in the hook 232. It should be recognized that the single body segment 236 of the ring attachment portion 230 is preferably thin, so as to render it flexible enough to loop around a rod or wire (not shown) such as wire or rod 80, 88, shown in FIGS. 1 and 4, but thick enough to provide a robust connection. Thus, the length of the body segment 236 is similar to the circumference of the expected diameter of the wire or rod to which the ring connection portion 230 will attach.

The ring connection portion 230 has a hook member 232 at its distal end that connects to the eye 224 by sliding the hook member 232 laterally from the open end 225 to the closed end 227. If the two walls defining the eye 224 are convergent from the open end 225 to the closed end 227, the constriction provided by the converging walls will wedge the hook member 232 into a greater interference fit so that it becomes difficult to withdraw the hook 232 from the closed end 227. Alternatively, a convergent wall separation can terminate at the closed end in an eyelet (not shown) that receives the hook 232 to retain it therewithin. In operation, the body segment 236 is first looped around the rod and then the hook 232 is inserted into the open end 225 and slid toward closed end 227, thereby connection the price display tag 210 to the rod. To remove the tag 210, the opposite of this operation is performed, i.e., the hook 232 is withdrawn from the closed end 227 to clear the eye 224 at the open end 225, and then the body segment 236 is unloosed from the rod.

Figure 8:
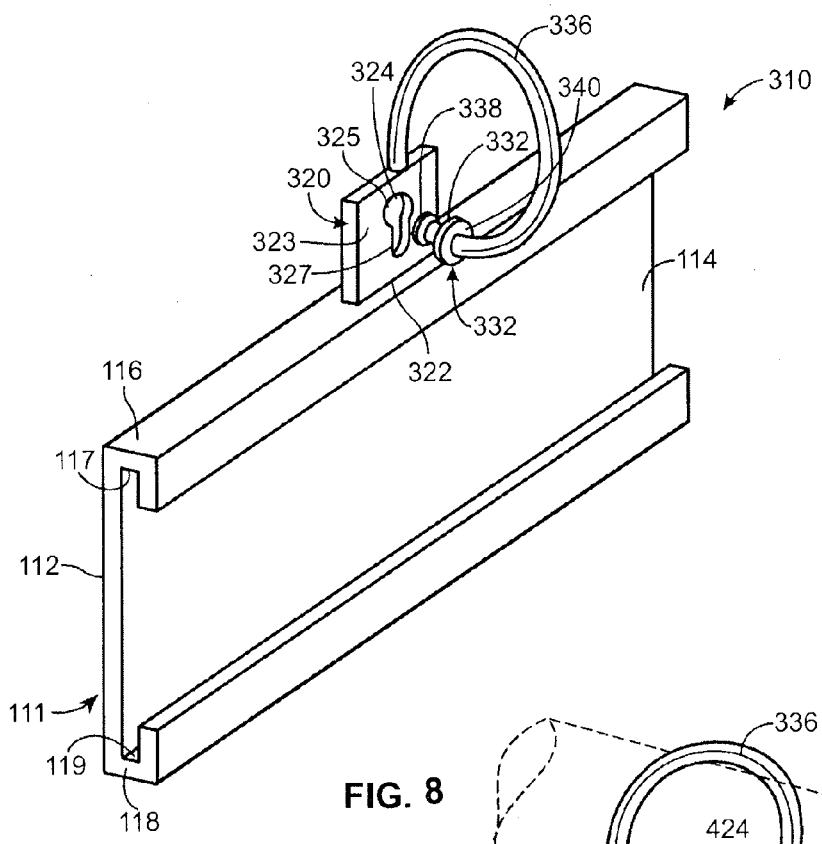
FIG. 8 is perspective view of a price tag holder according to another embodiment of the present invention.
Figure 9:
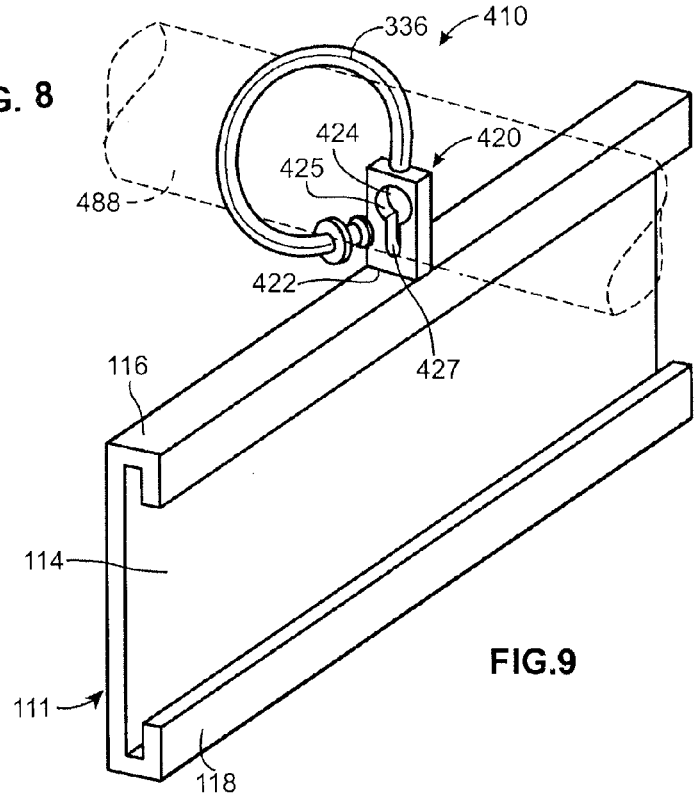
FIG. 9 is perspective view of a price tag holder according to yet another embodiment of the present invention shown being used in a typical retail environment.

The invention may be practiced by other modes besides the preferred ones shown in the above described embodiments, and alterations, modifications, substitutions, adaptations and changes may be come apparent to a person having ordinary skill in the art. For example, the shape of the ring segments 32, 34 may not need to be cylindrical, but may be square or oval. Other elements may also be changed to achieve additional necessary goals. For example, to further inhibit mischief or removal of the display tag holder from a store shelf, a locking mechanism may be adapted to keep the two segments attached to each other. For example, and as shown in FIGS. 8 and 9, alternative configurations for an connecting portions 320, 420, each different in their own way, are part of tag holders 310, 410, respectively, to include portions that remain identical to both tag holder 110 of FIG. 4 and to tag holder 210 of FIGS. 5 and 6. Identical parts are identified by identical numerals as the embodiment 1 10, shown in FIG. 4, and in the prior alternative embodiment 210.

Referring now to FIG. 8, another embodiment 310 of the inventive display tag holder is shown, in which the price tag display portion is the same as that of the price tag display portion 111 of the second embodiment 110 shown in FIG. 4. Since the only significant difference with tag holder 110 lies in the connecting portion 320, only that portion will be described below.

As shown in FIG. 8, the connecting portion 320 is also centrally disposed along the top edge 116, and has a longitudinally extending bottom edge 322 that provides for connection to the edge 116 along a central portion extending in a longitudinal direction. Although the connection portion 310 is shown as a rectangular shape, any shape, such as a truncated trapezoid as in FIG. 4, or other shape is possible.

The differences shown in the perspective view of FIG. 8 include a closed eye, in the general shape of a keyhole 324 for receiving the hook 332. The keyhole 324 includes a large opening 325 that narrows by converging to a smaller holding slot 327, the width of slot 327 being about the same as a projection portion 334 that ends in an end portion 338 of the hook 332. The slot 327 may taper to a slightly smaller width than the diameter of the projection 334 so as to provide a better interference fit to the hook 332, as will be apparent. A flanged portion 340 is larger than the diameter of the large opening 325 so as to permit insertion of the end 338 into the large opening 325 until the flanged portion 340 meets a wall 323 of the connecting portion 320, after which the projection 334 of the hook 332 is brought down to engage the walls of the slot 327. In this configuration, the hook end 338 maintains the loop formed by the flexible single body segment 336 of the connecting portion 320, and retains the tag holder on the wire or rod (not shown). The removal of the tag holder form its attachment requires the opposite procedure, in which the hook 332 is withdrawn by pulling it upwardly so the end 338 is adjacent the large opening 325 allowing it to be withdrawn from the keyhole 324, and unwinding of the flexible single body segment 336 permits the tag holder 320 to be removed from the wire or rack.

As shown in FIG. 9, connecting portion 420 is also centrally disposed along the top edge 116, but rather than being connected along a longitudinally extending direction, the bottom edge 422 extends in a transverse direction and provides for connection to the edge 116 along a central portion extending in a transverse direction. Again, although the connection portion 410 is shown as a rectangular shape, any shape, such as a truncated trapezoid as in FIG. 4, or any other shape is possible.

The differences between the embodiment 310 as shown in FIG. 8 and the one shown in the perspective view of FIG. 9 require that the connection of the tag holder 410 be made to a wire or rod 488 (shown in phantom) that extends from a front toward a rear of the rack on which the tag holder 410 is intended for attachment. The keyhole 424 also includes a large opening 425 that narrows by converging to a smaller holding slot 427, but because of the transverse orientation of the base of connection portion 420, the flexible single body segment 436 is looped in a plane that is parallel to the plane of the surface 114 of the tag holder 114. Otherwise the remaining elements except for possibly the dimensions, are similar or identical to the connecting portion 320 of the tag holder embodiment 320 shown in FIG. 8, and will not be further discussed herein.

Another difference between the tag holder 310 of FIG. 8 and the tag holder 410 of FIG. 9 is in the way the flexible single body segments 336 and 436 are looped around the wire or rod to which they are attached. For example, when the tag holder, is required to be attached to a rod that extends in the direction of the longitudinal extent of the rack or shelf tag holder 310 can be used. Conversely, when the tag holder is desirable for an attachment to a wire or rod that extends transverse to the longitudinal direction of the shelf or rack, then tag holder 410 can be used. As can be seen, the respective flexible single body segment 336 is looped around the wire or rod (not shown) in a plane transverse to the face 112 and, conversely, the flexible single body segment 436 is looped around the wire or rod 488 (shown in phantom) in a plane parallel to the face 112 of the price tag portion 111, so that in all instances, the surface 112 always faces the prospective purchaser, who is standing in front of the shelf or rack.

The invention herein has been described and illustrated with reference to the embodiments shown FIGS. 1-9, but it should be understood that the features and operation of the invention as described is susceptible to modification or alteration without departing significantly from the spirit of the invention. For example, the dimensions, size and shape of the various elements may be altered to fit specific applications or to accommodate different size and diameter rods. Other modifications will be apparent to those of ordinary skill, and accordingly, the specific embodiments illustrated and described herein are for illustrative purposes only and the invention is not limited except by the following claims and equivalents thereof.

What is claimed is:

1. A display tag holder suitable for mounting onto an external elongated support member, the display tag holder comprising an essentially planar display portion, a connecting portion and a ring attachment portion that is connected to the display portion by the connecting portion, the ring attachment portion consisting of two flexible resilient ring segments, each resilient ring segment including a proximal end closest to the display portion and at least one distal end, the two flexible resilient ring segments define a circumferential direction and a single ring plane in which the two flexible resilient ring segments essentially extend, and wherein the two distal ends of the resilient ring segments overlap to form an essentially spiraling semicircular attachment portion.

2. The display tag holder according to claim 1 wherein the at least two flexible resilient ring segments comprise a soft plastic.

3. The display tag holder according to claim 2 wherein the at least two flexible resilient ring segments comprise polypropylene.

4. A display tag holder suitable for mounting onto an external elongated support member, the display tag holder comprising an essentially planar display portion, a connecting portion and a ring attachment portion that is connected to the display portion by the connecting portion, the ring attachment portion consisting of at least one flexible resilient ring segment, the flexible ring segment including a proximal end closest to the display portion and at least one distal end, the resilient ring segment defining a circumferential direction and a ring plane in which the at least one flexible resilient ring segment essentially extends, wherein the resilient ring segment is attached to the display portion by the connecting portion so that the ring plane is essentially perpendicular to the display plane of the planar display portion, and wherein the one distal end of the resilient ring segment overlaps the other end to form an essentially spiraling semicircular attachment portion.

5. The display tag holder according to claim 4 wherein the external elongated tubular support member is a transversally extending wire of a wire display rack, whereby the essentially circular loop spiral of the ring attachment portion loops around the wire.

6. The display tag holder according to claim 4 wherein the external elongated tubular support member is a longitudinally extending wire of a wire display rack, whereby the essentially circular loop spiral of the ring attachment portion loops around the wire.

7. The display tag holder according to claim 6 wherein the plane of the essentially planar display portion is essentially parallel to the longitudinally extending wire of a wire display rack for mounting of the ring portion, whereby an interference fit of the ring attachment portion inhibits sideways displacement of the display tag along the longitudinally extending wire.

8. The display tag holder according to claim 5 wherein the external elongated tubular support member is essentially perpendicular to the transversally extending wire of a wire display rack to which the ring portion is mounted.

* * * * *